US005147235A

United States Patent [19]

Bamburak et al.

[11] Patent Number: 5,147,235

[45] Date of Patent: Sep. 15, 1992

[54] PROTECTIVE COVER FOR SURFBOARD

[75] Inventors: Robert Bamburak, Ortley Beach, N.J.; Robert Degnan, 224 24th Ave., South Seaside Park, N.J. 08752

[73] Assignee: Robert Degnan, South Seaside Park, N.J.

[21] Appl. No.: 549,109

[22] Filed: Jul. 6, 1990

Related U.S. Application Data

[63] Continuation-in-part of Ser. No. 281,812, Dec. 8, 1988, abandoned.

[51] Int. Cl.[5] ..... B63B 35/85

[52] U.S. Cl. ..... 441/79; 114/361

[58] Field of Search ..... 114/361; 441/74, 79; 224/917; 206/315.1, 522, 523; 383/25, 40, 72

[56] References Cited

U.S. PATENT DOCUMENTS

| | | | |
|---|---|---|---|
| 2,497,325 | 2/1950 | Scherba | 383/72 |
| 3,302,780 | 2/1967 | Massman et al. | 206/522 |
| 3,339,607 | 9/1967 | Howard | 441/74 X |
| 4,185,673 | 1/1980 | Daniello | 206/523 X |
| 4,483,380 | 11/1984 | Beran | 206/315.1 |
| 4,489,833 | 12/1984 | Bauer | 206/522 |
| 4,493,665 | 1/1985 | Liddle | 441/79 |
| 4,586,451 | 5/1986 | Mori et al. | 114/219 X |
| 4,719,952 | 1/1988 | Geronimo | 114/361 |
| 5,033,457 | 7/1991 | Hernandez | 441/74 X |

*Primary Examiner*—Sherman Basinger

*Attorney, Agent, or Firm*—Eckert Seamans Cherin & Mellott

[57] ABSTRACT

A protective cover for a surfboard or the like has a cushioned end with protective pockets to enclose the fin(s), and also can cover an end of the surfboard. The fin-receiving pockets are formed between air-filled plenums or bodies of shock-absorbing material such as foam. A closure strap can encircle the surfboard for holding the protective cover in place, or a zipper closure can be provided. Preferably a carrying strap is included, and/or a strap to hold the cover to a car-top carrier.

5 Claims, 3 Drawing Sheets

FIG. 4
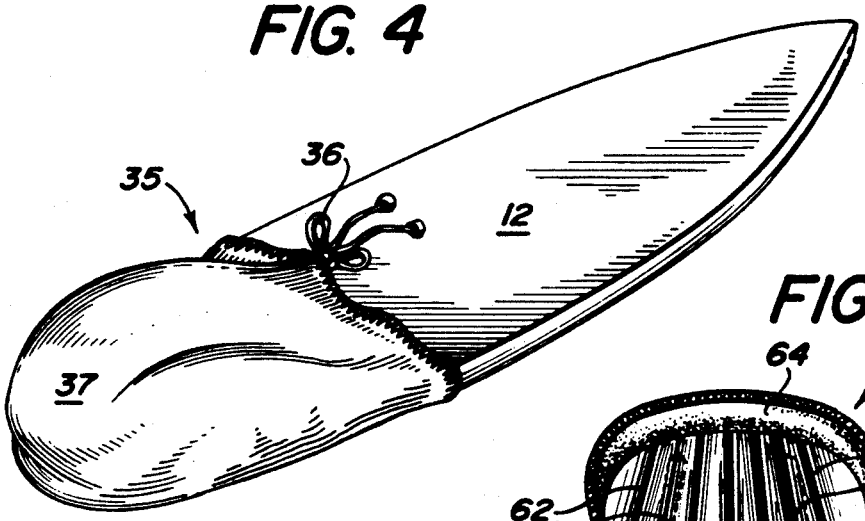
FIG. 7
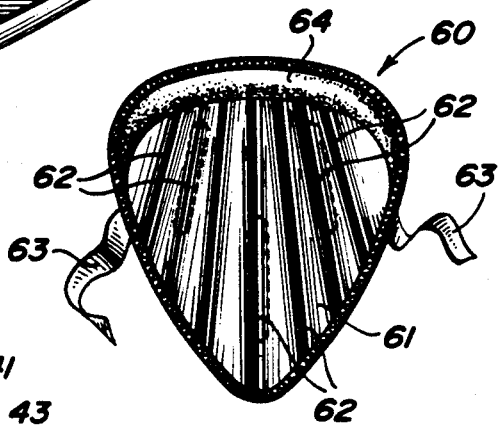
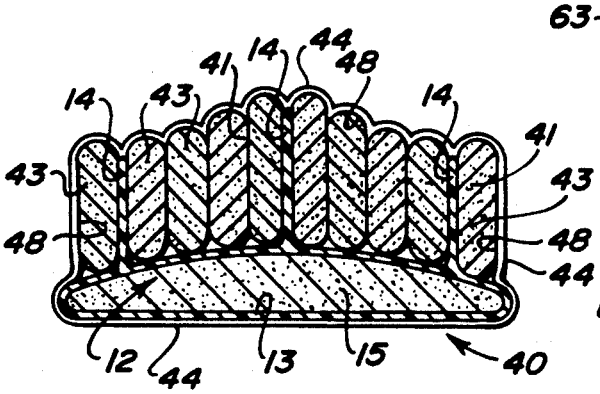
FIG. 5
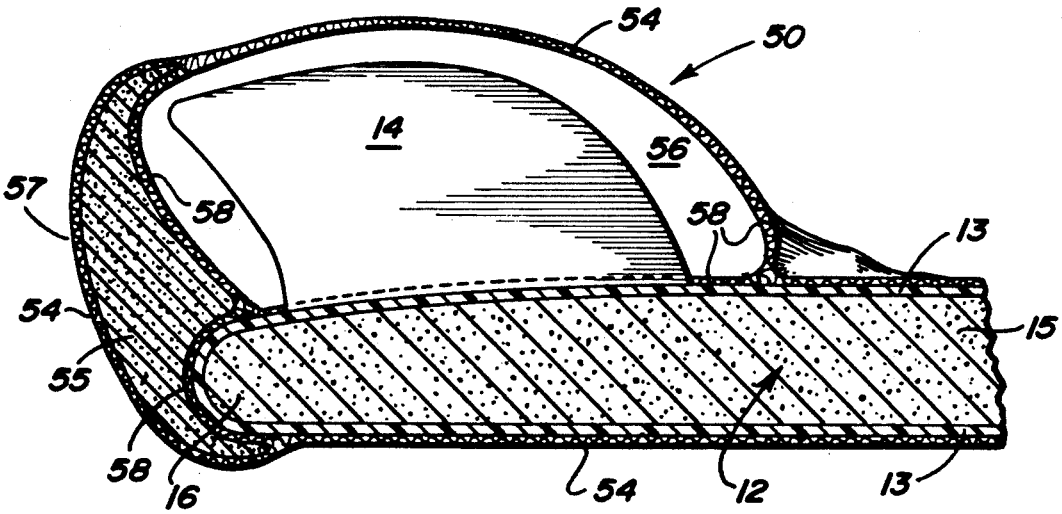
1 FIG. 6

PROTECTIVE COVER FOR SURFBOARD

CROSS REFERENCE TO RELATED APPLICATION

This is a continuation-in-part of application Ser. No. 281,812, filed Dec. 8, 1988, now abandoned.

BACKGROUND OF THE INVENTION

1. Field of the Invention

This invention relates generally to a protective cover for a surfboard and more particularly to a cover having components for providing extra protection to the fin(s) of a surfboard.

2. Description of the Prior Art

Over the years, surfing boards and sail boards have evolved from solid wood paddle and surfboards to today's modern, ultra-light polyurethane foam and fiberglass composition structures. Although their maneuverability has increased as their weight decreased, the newer surfboard compositions have a significant drawback in their susceptibility to damage from abrasive materials, cracking, stress fractures and impact. Such damage does more than merely detract from the visual appearance of this relatively expensive athletic equipment. Rather, the areas most vulnerable to such damage, the side rails and the fins, are essential for effective control of the surfboard in the water. Disruption of the carefully crafted contours of the rail edges through damage causes unwanted drag which affects the balance, maneuverability and performance of the surfboard. Moreover, crack and impact damage tend to focus the stresses of the board to the damaged area causing the injury to grow and expose more of the fragile porous foam inner core. As a result, the exposed core of a damaged surfboard is prone to the absorption of sea water which dramatically changes the symmetrical balance and handling of the board.

In the past, the majority of such damage was incurred through contact with rocks and other hard obstacles located on the sea shore when an unattended board was washed ashore by wave action after the rider was thrown from the board. However, modern day surfers utilize a tether to strap the surfboard to one of their ankles in order to prevent this occurrence. As a result, the majority of damage to modern day surfboards is incurred during storage and transit.

Prior art methods to deal with these problems have tended to involve relatively heavy, bulky, rigid surfboard cases provided with collapsible foam liners which encase the board much like a modern day guitar case. Aside from the bulk and expense of these rigid surfboard transportation cases, a serious drawback is the inability to store the case itself in a convenient location after the board has been removed for use. Such rigid cases are also difficult to mount on conventional automobile surfboard roof racks, especially when stacked in tandem, which is a common occurrence with unprotected boards.

An alternative protective device currently in use is a surfboard bag formed of a pliable woven fabric material and contoured to completely enclose the surfboard prior to closing the bag with a drawstring. Typical of this type of protection currently offered on the market are the bags offered by Pro-Lite of International Surfing Accessories and the bag marketed by Inseasons of PBI Sport Products. Also, U.S. Pat. No. 3,339,607 to Howard discloses a surfboard cover which is contoured to accept the surfboard fin and which uses a zipper closing. U.S. Pat. No. 4,483,380 to Beran discloses a foldable cover and carrier comprising a multiple-layer fabric strip which folds over a surfboard and is strapped in place. It also includes handle means and reinforcement. Though effective at absorbing minor impacts, such soft surfboard bags as described above provide little, if any, protection from the major impacts commonly associated with surfboard transportation and accidental dropping in transit or storage. Moreover, they provide no protection from the compressive or stress cracking forces associated with conventional surfboard roof racks.

Another alternative protective device, therefore, has been devised to offer protection to only the rail edges or the fin edges, with absorptive materials, such as beads or foam. Typical of such devices is U.S. Pat. No. 4,719,952 to Geronimo, which discloses a reusable, temporary shock absorbing cover which encloses the forward tip and edges of a surfboard. U.S. Pat. No. 4,586,451 to Mori discloses partial covers made of rubber, or the like material, which protect the nose, rails, and tail of a surfboard. Also on the market are offered various tip protectors such as the "Nose-Guard" by Surf Company, which is a shock absorbing bumper for the tip of a surfboard, and the "Boardsaver" from Bang-It, which is a rail protective cover strip.

There are no known covers which provide an effective structure to protect surfboard fins during transportation. Moreover, there is no known cover which is foldable or collapsible and which still offers the necessary shock and impact absorbing properties of the rail or nose covers combined with the ease of use and versatility of the board "bags".

SUMMARY OF THE INVENTION

The invention provides a surfboard cover which employs protective padding or shock absorbing elements for the most easily damaged portions of the surfboard, combined with the advantages of the pliable board bags.

In simplest form, the protective cover of the invention comprises a block-like cushioning means which rests on and around the fins, having slots for receiving one or more fins, and being provided with a holding means for securing the cushioning means to the board. The cushioning means may be filled with shock absorbing material such as foam or air.

In another embodiment of the invention, the surfboard cover is a generally elongated sleeve of flexible material adapted to receive and enclose either the entire surfboard or only the fin end of the surfboard. The sleeve comprises a cushion means having an opening which is provided with closure means. A lengthwise opening may be closed either with Velcro or with a zipper, and an end opening may be provided, for example with a drawstring, or the like. Alternatively, the sleeve may be a sheet of pliable material having a padded or cushioning portion which is folded into position over the surfboard and either zipped closed or held to the board by self-fastening straps.

The sleeve has cushion means with at least one slot or pocket and includes shock absorption means. The slot or pocket is positioned on the cushion means to overfit closely the fin of the surfboard thereby disposing a shock absorbing protective volume on and around the fin. A plurality of shock-absorbing pockets may be positioned to fit a plurality of fins, the tip, the end or other protuberances. The shock absorbing means may be provided by the insertion of shock absorbing foam material in plenums which are separated by the fin pockets, of the plenums may be air-filled.

Additionally, the sleeve may be fitted with a carrying strap.

It is, therefore, an object of this invention to provide a shock absorbing cushion for the fin(s) of a surfboard.

It is another object of the invention to provide a protective cover for a surfboard which not only covers the surfboard surface but which includes supplemental protection to the fin(s) by enveloping the fin(s) in a shock absorbing body.

It is a further object of this invention to provide a surfboard cover which utilizes air-filled plenums as a shock absorbent.

It is another object of this invention to provide a surfboard cover which covers an entire surfboard with a flexible sleeve and covers the fin and other damage-prone areas with a body of shock-absorbent means which attaches to the surfboard by means of at least one strap.

These and other objects will be more readily ascertainable to one skilled in the art from a consideration of the following figures, description and exemplary embodiments, with the understanding that the drawings are illustrative only and that changes may be made in the specific construction illustrated and described within the scope of the appended claims.

BRIEF DESCRIPTION OF THE DRAWINGS

FIG. 4, is a perspective view of a closed bag/sleeve which covers only a portion of the surfboard.

FIG. 5, illustrates in cross section an alternative fin pocket defined by plenums containing shock-absorbing material.

FIG. 6, is a fragmentary view of an end of a surfboard with a shock-absorbing body covering the surfboard end and with an open pocket around a surfboard fin.

FIG. 7, is a view of the protective cover in a simple form, defining a body to be placed over the fin and attached to the board by straps.

DETAILED DESCRIPTION OF THE PREFERRED EMBODIMENTS

Figure 1:
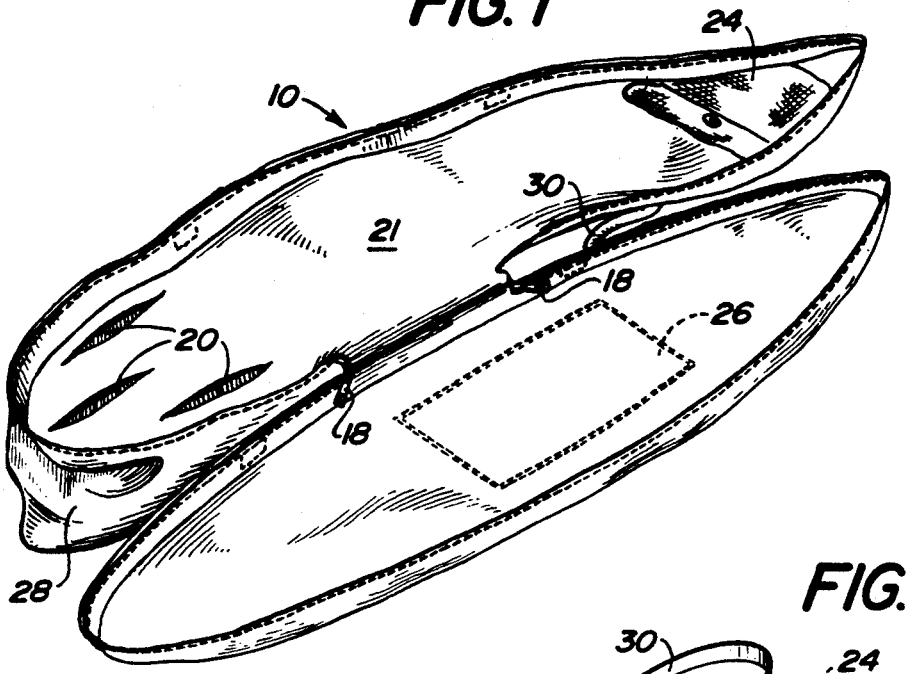
FIG. 1 is a perspective view of an embodiment of the invention which provides a full sized sleeve, closed by a zipper and including storage pockets.
Figure 2:
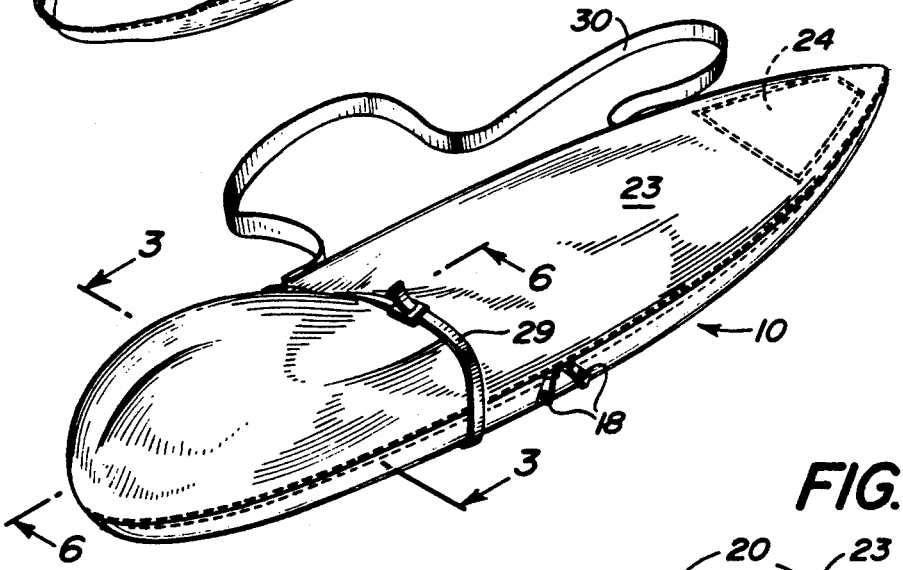
FIG. 2 illustrates the bag of FIG. 1 closed over a surfboard.
Figure 3:
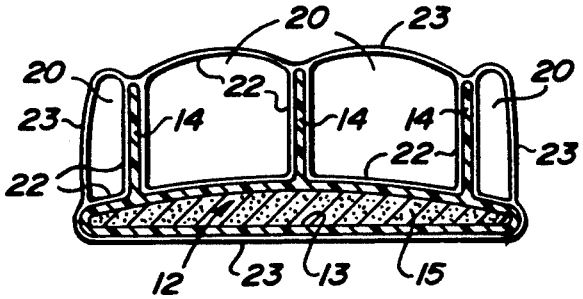
FIG. 3, taken on lines 3—3 of FIG. 2 illustrates the pockets which surround the surfboard fins.

Referring now to the drawings, and more particularly to FIGS. 1–3, surfboard cover 10 is formed by a flexible fabric sheet joined by zipper 18 to form a sleeve. Fabric 10 is preferably a lightweight, durable, water-resistant material. Surfboard cover 10 is sized to completely cover a surfboard, including the fins. Surfboards are made in different configurations. All are basically elongated disks having an inner core 15 and an outer layer of smooth "skin" 13. Each board may have a different number of fins, from one to four, three being a common number.

The exemplary surfboard covers illustrated herein are designed for surfboards having three fins 14, but it should be understood that they may be shaped to suit any surfboard configuration and any number of fins or other protrusions.

Interior storage pocket 24 and exterior storage pocket 26 may be used to store wetsuits or other apparatus needed at the surfing site. Carrying strap 30 is provided for easy transport of the covered board to the surfing site. Surfboard cover 10 is supplied with both zipper 18 and strap 29. Strap 29 may be used in addition to zipper 18 to hold sleeve 10 on the surfboard 12, or it may be used alone, without a zipper, in which case it is preferable to have more than one strap 29. Strap 29 may also be used to hold the covered surfboard to a car-top surfboard carrier.

Pocket 28 is formed at the end of the surfboard cover to protect the end of a surfboard. It may be defined by a space between plenums or sections which are air-filled, or filled with shock-absorbent material such as foam. The foam may comprise any synthetic material such as polyurethane, polystyrene, neoprene, or the like. The foam may be rigid or semi-rigid. Although not illustrated, a similar pocket may be formed at the opposite end of the bag to protect the surfboard tip.

Now referring particularly to FIG. 3, there is shown a cross section of a cushion having plenums 20 which protect fins 14 from damage. Cover 10 is formed of outer fabric layer 23, which covers the entire surfboard. Secondary layers of fabric 22 form plenums 20 and define interior walls 22, a part of each wall 22 being disposed in use adjacent a side of a fin 14. Air can be forced into plenums 20, which are then sealed, the trapped air forming a block-like cushion around the fin(s). Alternatively, a foam may be utilized to define the cushion.

The "skin" or outer layer 13 of a surfboard is particularly susceptible to nicks and paint crack damage. The surfboard cover 10 of this invention protects the outer surface of the surfboard with outer fabric layer 23 and protects the protruding fins with cushioned plenums 20, each type of protection being particularly suitable for protecting against the most likely damage.

Now referring to FIG. 4, an alternative embodiment 35 of the surfboard cover of the invention is shown covering the fins of a surfboard and extending part way over the surfboard end. In this embodiment, cover 35 is formed of a flexible fabric sleeve 37, closed at one end and open at the other end to form a pouch. The pouch is drawn over the end only of surfboard 12 and retained there by drawstring closure 36. Otherwise, the protection offered by surfboard cover 35 is similar to that described above in reference to FIGS. 1–3. Plenums defining between them pockets for the fins are filled with air or foam to enclose the protruding fins in a cushioned body. The outer layer of fabric protects the end and edges from nicks and denting.

Now referring to the alternative embodiment of FIG. 5, a cross section of the fin area of a surfboard is shown with the protective cover of the invention. Surfboard 12 has a core 15, an outer layer 13 and fins 14, enclosed at the fin area by cover 40, which defines plenums 41 for holding cushioning material on either side of each fin 14. Cover 40 has fabric outer layer 44, and inner fabric walls 48, which carry shock absorbing material 43, for example a foam or other shock absorbing material. Instead of carrying foam, sections adjacent to the fins can be inflatable, or can be pre-inflated and sealed. In that case, pocket walls can be formed on each side of each fin, or at least on the laterally outer sides of the outer fins, forming inflatable spaces for cushioning the fins.

In FIG. 6 another alternative embodiment is illustrated, showing surfboard 12 with core 15, fin 14, end 16 and outer "skin" 13. FIG. 6 shows a surfboard cover 50 with both types of shock absorbent plenums, namely pocket 56, which is defined between air filled plenums and protecting fin 14 and plenum 57 which contains foam to protect the end 16 of surfboard 12. Protective plenum 57 is shown to extend over the back end 16 of surfboard 12. It should be understood that similar protection can also be formed at the front end of the board (not illustrated)or the protective body can rest over the fins on the board without wrapping around the end of the board. Plenum 57 is formed by outer fabric wall 54 and secondary inner fabric wall 58, between which a shock absorbent material is disposed, preferably foam. The plenum forming pocket 56 is defined between layers 54 and 58, and air is forced between the walls to form a shock absorbent cushioning for fin 14. The air can be trapped in a sealed chamber, or suitable valve means can be included to inflate the chamber when used.

FIG. 7 shows the protective cover of the invention in a simple form, namely, as a fin cover 60 comprising cushion 61 having a plurality of slots or pockets 62. When placed on the fins of a surfboard (not shown) straps 63,63' are utilized to hold the cover 60 in place over the fins. Optionally, there may be provided a fabric edging 64 to cover and protect the end of the surfboard and to prevent slippage of the cover 61. The cushion 61 may be air fillable and collapsible for easy storage. Alternatively, the cushion may have a flexible foam interior.

Figure 8:
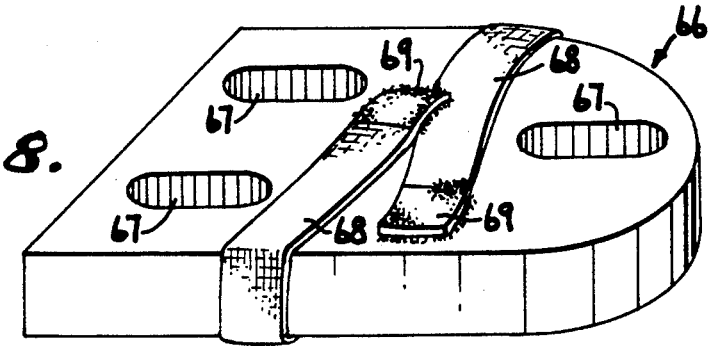
FIG. 8, is a perspective view of an embodiment of the invention wherein the shock absorbing body defines a resilient pocketed block which covers and protects the rear portion of the surfboard on and around the fins.
Figure 9:
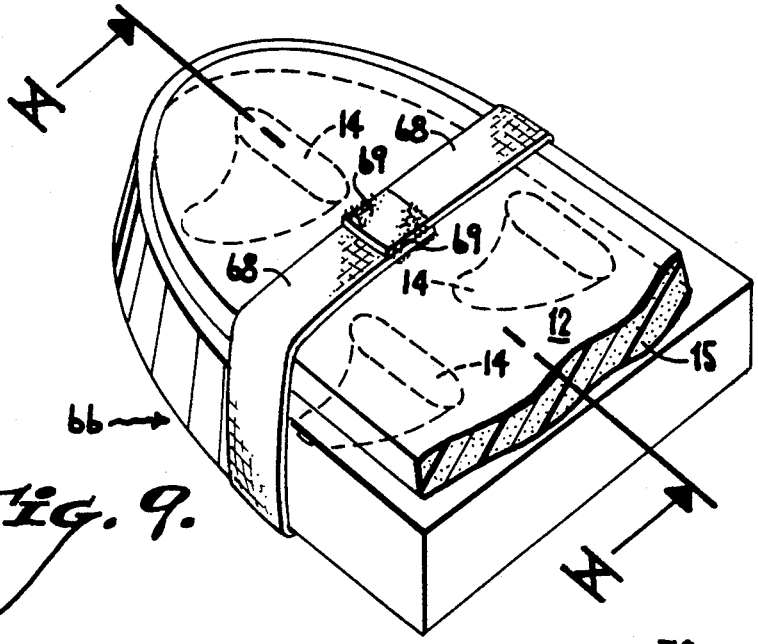
FIG. 9, illustrates the embodiment of FIG. 8 fitted to the rear portion of the surfboard, the surfboard being shown broken away for clarity.
Figure 10:
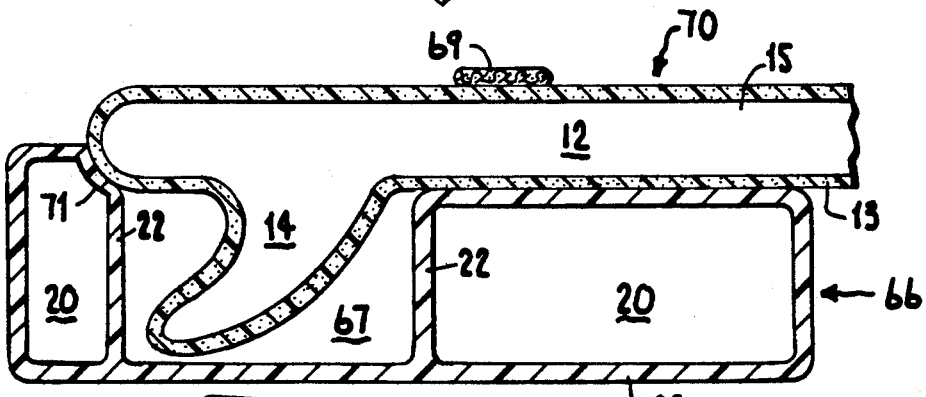
FIG. 10, taken on lines 10—10 of FIG. 9 illustrates the pockets which surround the surfboard fins and the structure of the embodiment of FIG. 8.

Now referring to FIGS. 8, 9 and 10, an embodiment 66 of the surfboard cover of the invention is shown covering the fins and the end of the surfboard. This embodiment has outer walls and inner walls defining areas 20 which are filled with either air or foam and which surround and protect fins 14 which are inserted into fin pockets 67. The cushion-like block 66 of the invention is retained in position on the surfboard 12 by straps 68 which are passed around surfboard 70 and which are secured together by a fastening means 69. Sufficient tension can be created by fastening means 69 to deform the surface of block 66, thus also forming a rear terminus protecting depression 71 which at least slightly encompasses and protects the rear terminus of the surfboard. Alternatively, the block can rest flush against the lower surface of the board. In the preferred embodiment the straps 68 are fastened to one another using velcro strips which are affixed at the ends of straps 68.

There are several variations which can be practiced in the scope of this invention. The surfboard cover may cover the entire length of the surfboard, or it may cover only the most vulnerable part of the surfboard. The sleeve may be closed with a zipper or a drawstring or by straps. The sleeve may be replaced entirely by straps for holding the cushion in place. The protective pockets may be defined by air-filled plenums or those comprising a shock absorbing material such as polyurethane foam. The number and position the slots or pockets may vary according to the configuration of the surfboard to be protected.

Generally, the invention is an elongated structure 10 having a cushion or padded portion which forms a protective cover for the fins 14 of a surfboard 12. The cover 10 is made of flexible fabric having a cushion which is at least partially open for receiving and protecting the fin of a surfboard therein. At least one cushioned pocket 28 protects an end of the surfboard and at least one other cushioned pocket 20 protects the fin(s) 14 of the surfboard. Closure means 18 are provided to hold the structure on the surfboard. Storage pockets 24 and 26 and carrying straps 30 and 29 are optional. Air pockets 20 are formed by capturing air between an exterior layer of wall 23 and interior layers 22, which form beside adjacent the fins.

The sleeve/bag/block 10 may cover the entire surfboard or the sleeve/bag 50 may cover only that portion of the surfboard most susceptible to damage, i.e., the fins. Partial bag/sleeve 50 has a closure in the form of a drawstring.

The pockets 20 are made shock absorbent by air or by shock absorbing material such as foam. An end of the surfboard can be protected by either air formed pocket 28 or foam protector 55. When air is utilized the cushion may be made to be collapsible for storage, with valve means provided for inflation and deflation.

There are many advantages to the surfboard cover of this invention. Chiefly, it provides a protective cover for the fins alone or for the entire surfboard while adding shock absorbing means for protection of those areas most vulnerable to damage during transport.

Having now illustrated and described my invention, it is not intended that such description limit this invention, but rather that this invention be limited only by reasonable interpretation of the appended claims.

What is claimed is:

1. A fin protecting cover for a surfboard having at least one fin protruding therefrom, the cover comprising:

a shock absorbing cushion means forming a cushioning block sized to fit against the surfboard at the protruding fin, the cushioning block defining a resilient body with a pocket spaced inwardly from sides of the block for receiving the protruding fin, the cushioning block occupying a space around the fin for protecting the fin; and, means for attaching said cushion means to the surfboard so as to retain the cushioning block over the fin.

2. The fin protecting cover according to claim 1, wherein the cushioning block is positioned substantially on a side of the surfboard from which the fin protrudes, and wherein said means for attaching said cushion means comprises a strap encircling the surfboard on an opposite side.

3. The fin protecting cover according to claim 1, wherein the cushioning block includes foam.

4. The fin protecting cover according to claim 1, wherein the cushioning block includes at least one inflatable plenum.

5. The fin protecting cover according to claim 1, wherein the cushioning block includes at least one inflated and sealed plenum.

* * * * *